US006254100B1

(12) United States Patent
Rinehart

(10) Patent No.: US 6,254,100 B1
(45) Date of Patent: Jul. 3, 2001

(54) ARCHERY TARGET WITH REPLACEABLE TARGET SECTION

(75) Inventor: John R. Rinehart, Milton, WI (US)

(73) Assignee: Rinehart Family Company, Janesville, WI (US)

( * ) Notice: Subject to any disclaimer, the term of this patent is extended or adjusted under 35 U.S.C. 154(b) by 0 days.

(21) Appl. No.: 09/314,100

(22) Filed: May 18, 1999

(51) Int. Cl.[7] ..... F41J 3/00
(52) U.S. Cl. ..... 273/403; 273/408
(58) Field of Search ..... 473/403, 404, 473/406, 407, 408

(56) References Cited

U.S. PATENT DOCUMENTS

| | | | | |
|---|---|---|---|---|
| 858,090 | | 6/1907 | Meinecke . | |
| 1,818,939 | | 8/1931 | Brading . | |
| 2,812,947 | | 11/1957 | Fatzinger et al. . | |
| 3,163,418 | | 12/1964 | Myers . | |
| 3,164,384 | | 1/1965 | Stewart . | |
| 4,054,288 | | 10/1977 | Perrine, Sr. . | |
| 4,066,261 | | 1/1978 | Stewart . | |
| 4,239,236 | | 12/1980 | Parham et al. . | |
| 4,477,082 | | 10/1984 | McKenzie et al. . | |
| 4,597,574 | | 7/1986 | Wolfe . | |
| 4,643,434 | * | 2/1987 | Carlin | 273/408 |
| 5,308,084 | | 5/1994 | Morrell . | |
| 5,383,671 | | 1/1995 | Teets et al. . | |
| 5,498,001 | | 3/1996 | Franks et al. . | |
| 5,503,403 | | 4/1996 | Morrell . | |
| 5,540,446 | | 7/1996 | Felsen . | |
| 5,669,610 | * | 9/1997 | Salyers | 273/408 |
| 5,816,579 | * | 10/1998 | Broussard et al. | 273/408 |

FOREIGN PATENT DOCUMENTS

| | | | | |
|---|---|---|---|---|
| 639503 | * | 12/1990 | (GB) | 273/408 |
| 9015964 | * | 12/1990 | (WO) | 273/408 |

* cited by examiner

*Primary Examiner*—Mark S. Graham
(74) *Attorney, Agent, or Firm*—Foley & Lardner

(57) ABSTRACT

An archery target includes a target body section having a target section aperture formed therein and a replaceable target section adapted to fit in the target section aperture. The replaceable target section is held in place in the target section aperture by one or more support rods extending through support rod apertures formed in the body section and the replaceable target section. The support rods may also extend into other target body sections, to hold the target body sections together to form a structurally stable archery target. A replaceable target insert may be positioned in a target insert aperture formed in the replaceable target section. The replaceable target insert may be held in place in the replaceable target section by a support rod extending therethrough. The archery target is easily disassembled by removing the support rods to remove the replaceable target insert and/or replaceable target section therefrom to replace the replaceable target section and/or target insert when it becomes excessively damaged due to arrow strikes. Thus, the life of the archery target is extended, and the operating cost thereof reduced, by providing for replacement of portions of the archery target which are likely to become more damaged than other portions of the archery target. An archery target in accordance with the present invention may be molded of a polyurethane foam material in the shape and size of a game animal.

27 Claims, 5 Drawing Sheets

ARCHERY TARGET WITH REPLACEABLE TARGET SECTION

FIELD OF THE INVENTION

This invention pertains generally to archery targets, and more particularly to a three-dimensional archery target with a replaceable target section.

BACKGROUND OF THE INVENTION

Various types of archery targets are known, including conventional three-dimensional life-size animal-simulating archery targets. Such targets have a shape resembling that of a game animal, for example, a deer or other animal. Such targets may be formed in a single piece from a lightweight foam material, such as polyurethane foam. Such targets are adapted for use with both broadhead arrows, which comprise a plurality of intersecting razor blades tapering to a sharp point, and field point or target arrows. Critical target areas may be indicated on the target, e.g., by bull's eye markings which are either applied onto or molded into the foam target.

Repeated arrow strikes on a foam archery target will cause the target to deteriorate. This is especially true when broadhead arrows are used. When a broadhead arrow hits a target, the blades forming the arrowhead slice through the target material to a considerable depth. As the target material is hit repeatedly, pieces of the target are cut loose. Therefore, a target is destroyed much more rapidly with broadhead arrows than with field point or target head arrows. However, even when field point or target head arrows exclusively are used, at least a portion of the target will inevitably be destroyed with repeated use.

In practice, a very large proportion of the arrow strikes on an archery target fall within a relatively small portion of the target. For example, an archer will typically aim at an area of the target corresponding to vital organs of the animal which the target represents. Most archers will hit this target or bull's eye area most of the time. Therefore, this target area will be destroyed rapidly, due to repeated arrow strikes, while most of the remaining target remains relatively undamaged.

The functional life of a three-dimensional life-size animal simulating archery target may be extended, and the cost of using such a target reduced, by making replaceable a target section of the archery target which is likely to be destroyed rapidly due to repeated arrow strikes. Instead of forming the target from a single piece of molded foam, a three-dimensional life-size animal simulating archery target may be molded in multiple pieces, which are detachably joined together to form the target. As one piece of the target, i.e., the target section, is destroyed by repeated arrow strikes, this section alone may be replaced, eliminating the need to replace the entire target. Thus, the life of the target is extended, and the operating cost thereof reduced.

An exemplary multi-section three-dimensional life-size animal simulating archery target of this type is described in U.S. Pat. No. 4,477,082 to McKenzie, et al. This patent describes a three-dimensional archery target including head and tail body sections with a replaceable target section positioned therebetween. The target section is connected to the other body sections by dovetail joint structures formed in the molded foam body sections. As the target section, corresponding generally to the chest area of the animal, is destroyed by repeated arrow strikes, it may be replaced. It is noted, however, that the replaceable target section comprises approximately one-third of the total target. Thus, it is relatively expensive to replace. Further, the vertical dovetails holding the body sections together tend to come apart with repeated arrow strikes, due to the dynamic force of arrows impacting the target.

Another known three-dimensional life-size animal-simulating archery target is described in U.S. Pat. No. 5,503,403 to Morrell. This archery target includes a foam body, which may be formed of front and rear body sections connected together by a dovetail joint structure. The foam body includes a target insert receiving recess into which a target insert is placed. The target insert may be filled with packing material, such as cotton molt, for use with only target arrows, or may be formed of foam, for use with both broadhead and target arrows. The target insert may be held in place in the recess using straps and wire. A body cover, which may be made of cloth, or molded in foam, is used to cover the removable and replaceable target insert.

SUMMARY OF INVENTION

The present invention provides a three-dimensional archery target having a replaceable target section, which is easy to assemble and structurally stable during the use and transportation thereof. An archery target in accordance with the present invention includes one or more target body sections. The target body sections may be molded of a polyurethane foam material, and are preferably shaped and sized to represent a game animal in a realistic fashion. The target body sections are connected together via a support structure, such as dovetail joint structures molded into the target body sections. At least one of the target body sections includes a target section aperture formed therein. A replaceable target section, also molded of polyurethane foam, is positioned in the target section aperture. One or more support rods are positioned in support rod apertures formed through the replaceable target section and the target body section in which the replaceable target section is placed, to hold the replaceable target section in position therein. The support rods also preferably extend into support rod apertures formed in other body sections of the archery target. The support rods thus hold the archery target together, to provide a structurally stable archery target during use, but are easily removable, to disassemble the archery target, for example, to replace the replaceable target section.

The replaceable target section may have a target insert aperture formed therein, into which a replaceable target insert is placed. At least one of the support rods extending through the replaceable target section preferably also extends through a support rod aperture formed in the replaceable target insert, to hold the replaceable target insert in position in the replaceable target section.

The replaceable target section and replaceable target insert are used for portions of an archery target in accordance with the present invention which are most likely to be destroyed by repeated arrow strikes. The useful life of an archery target in accordance with the present invention is increased, and the operating cost thereof reduced, by replacing the replaceable target insert and/or the replaceable target section when it becomes destroyed, rather than replacing the entire archery target. The replaceable target section and replaceable target insert preferably are designed for easy replacement, by reducing friction between the replaceable target section and the replaceable target insert and the apertures in which they are positioned. The easily removable and insertable support rods extended through the support rod apertures formed through the replaceable target section and the replaceable target insert ensure that these pieces are held firmly in place when arrows strike them and/or are removed from them, and provide structural integrity to the archery target as a whole.

Further objects, features, and advantages of the present invention will be apparent from the following detailed description taken in conjunction with the accompanying drawings.

DETAILED DESCRIPTION OF THE INVENTION

Figure 1:
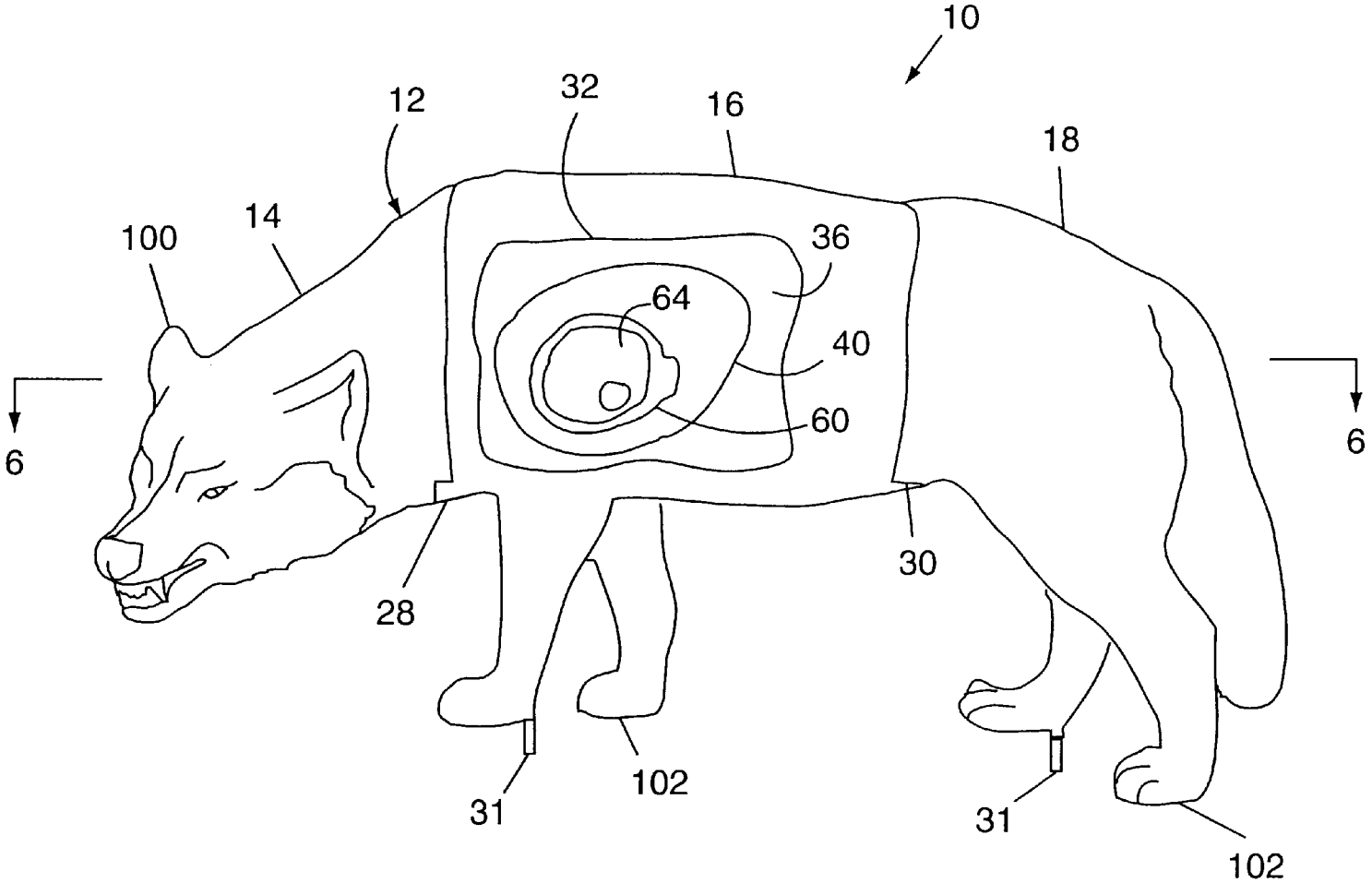
FIG. 1 is a side view of an exemplary three-dimensional archery target having a replaceable target section in accordance with the present invention.
Figure 2:
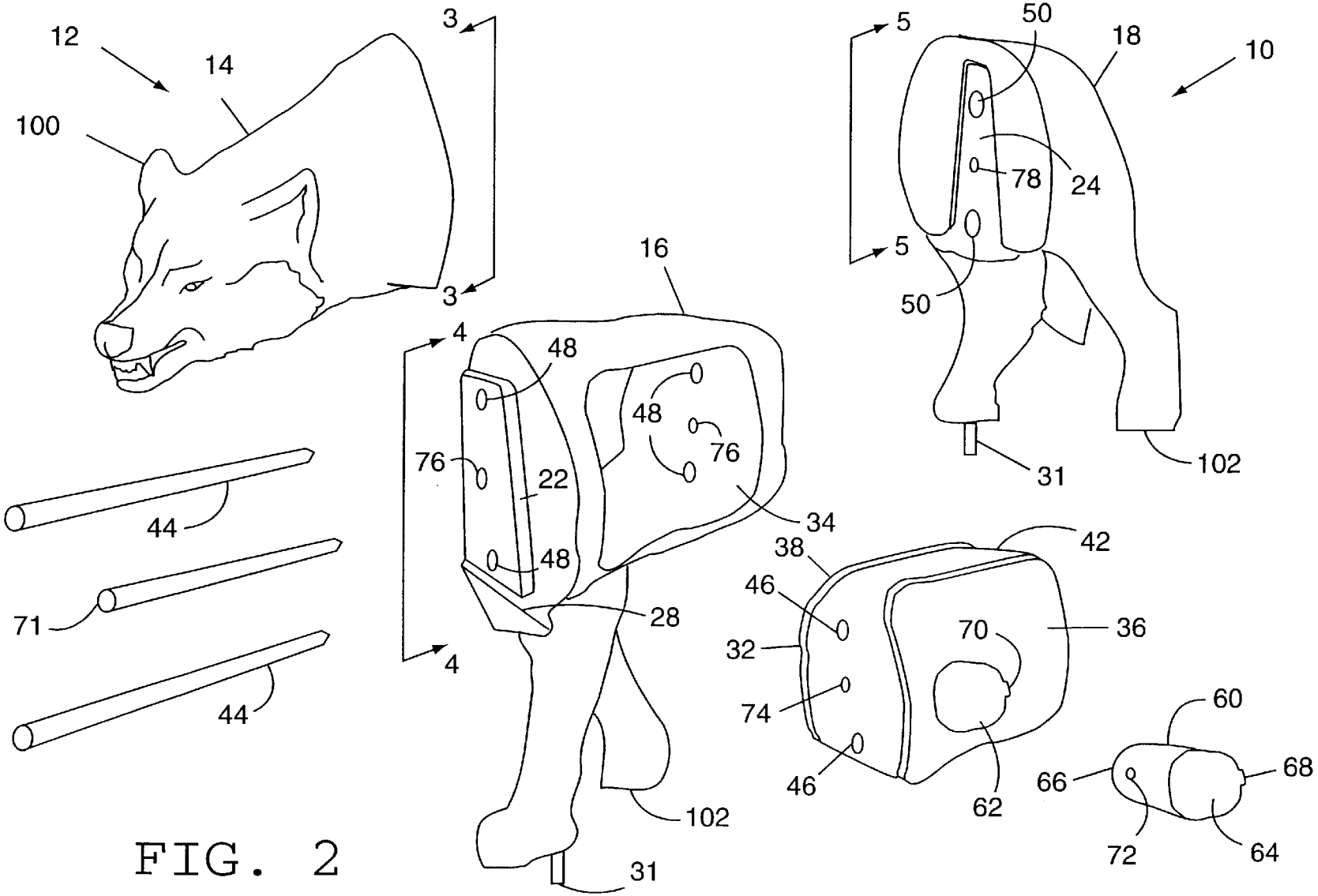
FIG. 2 is an exploded perspective view of the exemplary three-dimensional archery target in accordance with the present invention of FIG. 1.
Figure 3:
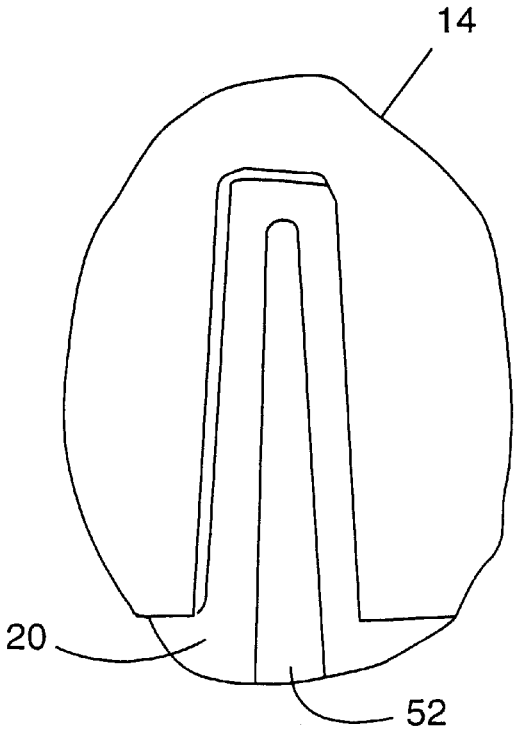
FIG. 3 is a view of a head body section of the exemplary three-dimensional archery target in accordance with the present invention of FIGS. 1 and 2, as taken along the line 3—3 of FIG. 2.
Figure 5:
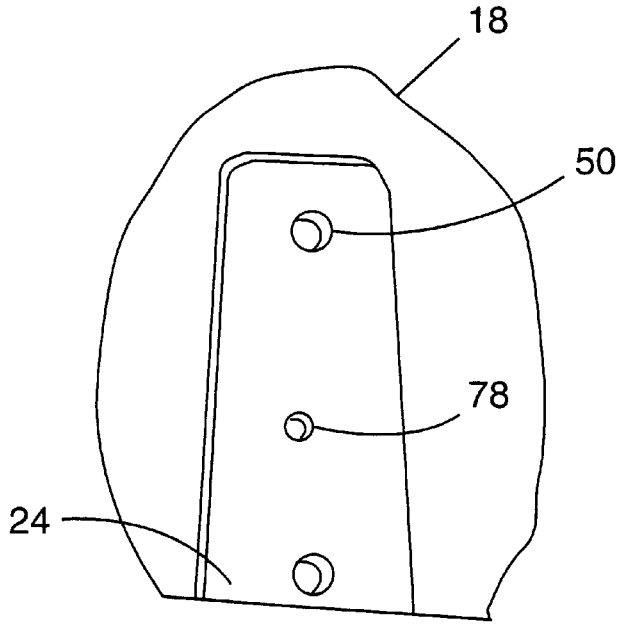
FIG. 5 is a view of a tail body section of the exemplary three-dimensional archery target in accordance with the present invention of FIGS. 1 and 2, as taken along the line 5—5 of FIG. 2.

An exemplary three-dimensional archery target 10 having a replaceable target section in accordance with the present invention is illustrated in, and will be described with reference to, FIGS. 1–6. A three-dimensional archery target 10 in accordance with the present invention is preferably formed in the shape and size of a game animal. For example, a three-dimensional archery target 10 in accordance with the present invention may be formed in the shape and size of a wolf, as illustrated in FIGS. 1–6. However, it should be understood that a three-dimensional archery target 10 in accordance with the present invention may be formed in the shape and size of any other type of animal, such as a deer, bear, or other game animal, or may have any shape or be of any size desired.

A three-dimensional archery target 10 in accordance with the present invention includes a target body 12, which may include a plurality of body sections which are connected together to define the overall shape of the archery target 10. In the exemplary embodiment of the invention illustrated in FIGS. 1–6, the archery target body 12 includes three body sections, a head body section 14, a central body section 16, and a tail body section 18. It should be understood that a three-dimensional archery target in accordance with the present invention may have more, fewer, or different body sections than those illustrated and described by example herein. For example, the central 16 and tail 18 body sections may be combined into a single body section.

The three body sections 14, 16, and 18 may be joined together to form the body 12 of the three-dimensional archery target 10 in a conventional manner. For example, a dovetail or tongue-and-groove type support structure may be employed. Thus, the head body section 14 may have a recessed groove 20 formed on an end thereof which is to be joined to the central body section 16. A corresponding extending portion 22 is formed on a head end of the central body section 16 which is to be joined to the head body section 14. The extending portion 22 of the central body section 16 is designed to slide into the recessed groove 20 formed in the head body section 14 to join the head body section 14 to the central body section 16 in a conventional manner. In a similar manner, a recessed groove 24 may be formed in an end of the tail body section 18 which is to be joined to the central body section 16. A corresponding extending portion 26 is formed on a tail end of the central body section 16 which is to be joined to the tail body section 18. The extending portion 26 of the central body section 16 is designed to fit into the recessed groove 24 formed in the tail body section 18 to join the tail body section 18 to the central body section 16 in a conventional manner. The recessed grooves 20 and 24 formed in the head 14 and tail 18 body sections are preferably wider at a bottom open end thereof than at a top closed end thereof. Similarly, the extending portions 22 and 26 formed on the central body section 16 are preferably more narrow at a top thereof than at a bottom thereof. The resulting corresponding angled walls provided in the recessed grooves 20 and 24 and extending portions 22 and 26 allow the extending portions 22 and 26 to be inserted easily into the open ends of the recessed grooves 20 and 24, respectively. This allows the head 14 and tail 18 body sections to be attached more easily to the central body section 16, by reducing friction between the body sections and, particularly, between the recessed grooves 20 and 24 and the outer surfaces of the extending portions 22 and 26 until the head 14 and tail 18 body sections are placed in the desired position with respect to the central body section 16. The head 14 and tail 18 body sections are in the proper position with respect to the central body section 16 when the top edges of the extending portions 22 and 26 of the central body section 16 contact the top closed ends of the recessed grooves 20 and 24 in the head 14 and tail 18 body sections, respectively. An extending ledge 28 and 30 is preferably formed at each end of the central body section 16, where the central body section 16 is attached to the head 14 and tail 18 body sections, respectively. The extending ledges 28 and 30 provide further support for the head 14 and tail 18 body sections, respectively, when the head 14 and tail 18 body sections are attached to the central body section 16. The head 14, central 16, and tail 18 body sections are preferably formed such that when the body sections 14, 16, and 18 are joined together in the manner described, a target body 12 defining the desired shape of the three-dimensional archery target 10 is formed.

A mounting structure is preferably attached to the target body 12 to facilitate mounting the target 10 in position for use. For example, mounting rods or tubes 31 may be provided extending from the bottom of one or more sections of the target body 12. The mounting rods or tubes 31 are preferably made of a strong rigid material, such as metal, e.g., aluminum or steel, and may be molded into the target body 12 during the process of forming the sections thereof, to extend therefrom. The archery target 10 may be mounted in position for use by driving the mounting rods 31 into the ground or, preferably, by driving stakes into the ground and attaching the mounting rods or tubes 31 thereto by, for example, placing open ends of the mounting tubes 31 over exposed ends of the stakes.

With use, certain portions of an archery target 10 are likely to receive many more arrow strikes than other portions of the archery target 10. Such bull's eye or target portions of the archery target 10 may correspond, for example, to portions of the body of an animal represented by the target 10 corresponding to critical target areas, i.e., portions of the target animal's body containing vital organs, etc. Such target portions of an archery target 10 will tend to deteriorate more rapidly, due to repeated arrow strikes, than other portions of the archery target 10. In accordance with the present invention, a target section 32 of the archery target 10 is made replaceable. When the replaceable target section 32 becomes excessively damaged, due to repeated arrow strikes, the target section 32 may be replaced with a new target section 32. Thus, the archery target 10 may be restored to a useful condition without requiring replacement of the entire archery target 10. The use of a replaceable target section 32 increases the useful life of and, therefore, reduces the operational cost of, a three-dimensional archery target in accordance with the present invention.

In accordance with the present invention, a replaceable target section 32 is provided as a portion of one of the target body sections 14, 16, or 18 which, preferably, corresponds to critical target areas of the animal represented by the target 10, and which, therefore, is likely to receive many more arrow strikes than other portions of the archery target 10. In the exemplary embodiment of the present invention illustrated and described herein, the replaceable target section 32 is positioned in the central target body section 16. Of course, it should be understood that the replaceable target section 32 may be positioned in another, or more than one, target body section.

The replaceable target section 32 is mounted in a target section aperture 34 formed in the central body section 16 of the archery target 10. The target section aperture 34 may be formed in the central body section 16 during the process of forming the central body section 16. The target section aperture 34 may be formed to extend partially or entirely through the central body section 16, as illustrated. In the latter case, the replaceable target section 32 is formed to fill the target section aperture 34 such that, when the replaceable target section 32 is positioned in the target section aperture 34, opposing outside ends 36 and 38 of the replaceable target section 32 conform to the outer surface of the central body section 16 on each side of the central body section 16. The outside ends 36 and 38 of the replaceable target section 32 are preferably formed with the appropriate contours and texture such that the replaceable target section 32 blends into the central body section 16 when positioned in the target section aperture 34. The replaceable target section 32 may also preferably have bull's eye or other target marks 40 applied to or formed in at least one of the outside ends 36 thereof. Such target marks 40 may be formed in a conventional manner, by painting or otherwise applying such marks 40 to the outside ends 36 of the replaceable target section 32, or, alternatively, by molding a three-dimensional ridge or groove in the replaceable target section 32 to form the target marks 40.

One end 38 of the replaceable target section 32 preferably is made smaller than the other end 36 of the replaceable target section 32. Correspondingly, the target section aperture 34 is preferably shaped to be smaller at one end than at the other end thereof. This facilitates insertion of the replaceable target section 32 into the target section aperture 34 by reducing friction between the surfaces of the replaceable target section 32 and the target section aperture 34 until the replaceable target section is placed in the proper position in the target section aperture 34. It also facilitates placing the replaceable target section 32 in the proper orientation in the target section aperture 34.

Figure 4:
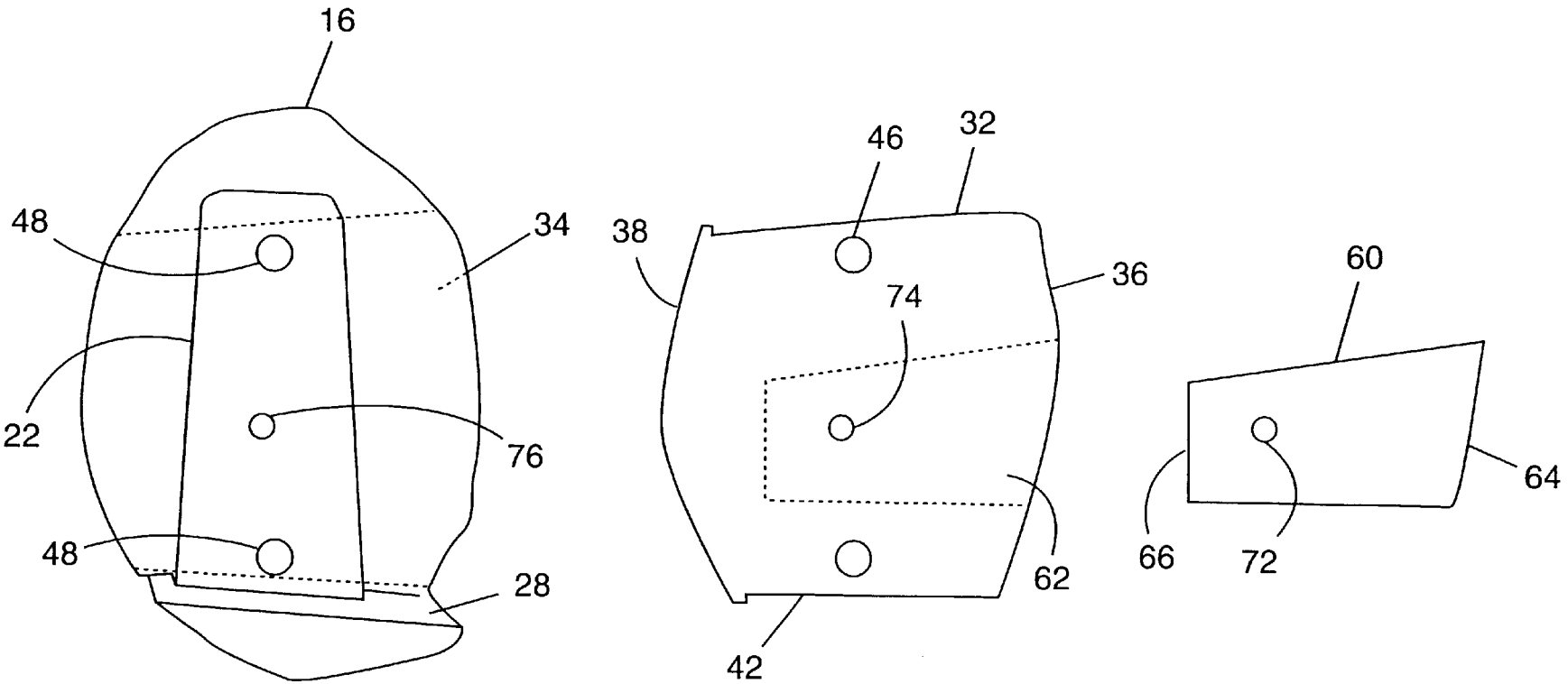
FIG. 4 is an exploded view of a central body section, a replaceable target section, and a replaceable target insert of the exemplary three-dimensional archery target in accordance with the present invention of FIGS. 1 and 2, as taken along the line 4—4 of FIG. 2.
Figure 6:
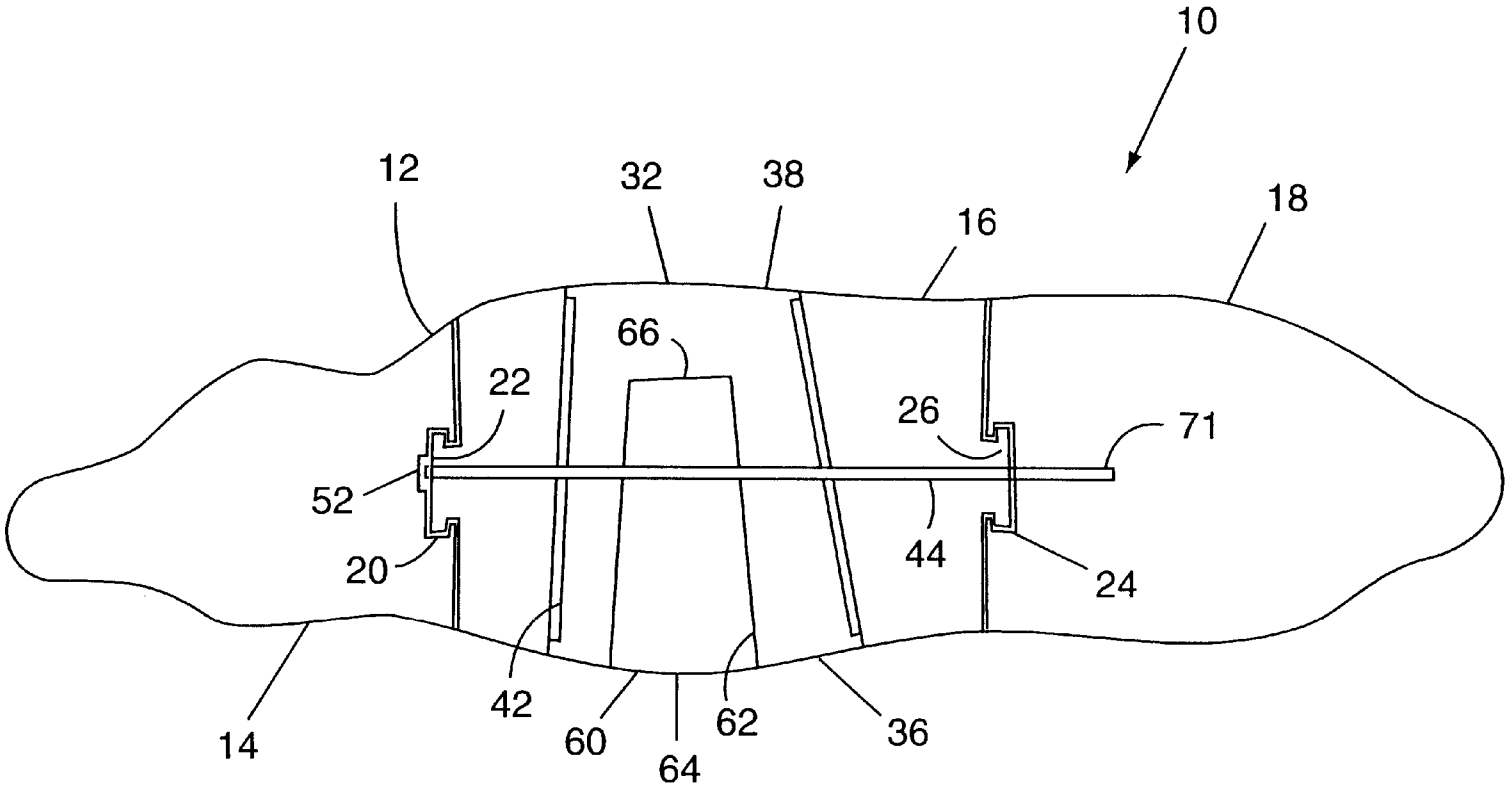
FIG. 6 is a cross-sectional view of the exemplary three-dimensional archery target in accordance with the present invention of FIG. 1, as taken along the line 6—6 of FIG. 1.

Preferably, the cross-sectional area of an interior portion 42 of the replaceable target section 32 is smaller than the adjacent outside ends 36 and 38 of the replaceable target section 32. (Thus, the replaceable target section 32 has a somewhat hour-glass shaped cross-section, as illustrated in FIGS. 4 and 6.) This further reduces friction between the replaceable target section 32 and adjacent surfaces of the target section aperture 34, to facilitate placement of the replaceable target section 32 within the target section aperture 34.

In accordance with the present invention, the replaceable target section 32 is held in position in the three-dimensional archery target 10 by one or more support rods 44 which extend through support rod apertures 46 formed in the replaceable target section 32 and corresponding support rod apertures 48 formed in the section of the target body 12 in which the replaceable target section 32 is mounted. For example, in the exemplary embodiment illustrated and described herein, the replaceable target section 32 is positioned in the central target body section 16 and held in place therein by removable support rods 44 which are extended through support rod apertures 48 formed in the central body section 16 into corresponding support rod apertures 46 formed in the replaceable target section 32. The support rods 44 preferably extend entirely through the replaceable target section 32 into support rod apertures 48 formed in the central body section 16 on opposite sides of the target section aperture 34. The support rods 44 may be hollow or solid, and made of any appropriate rigid or semi-rigid material, such as plastic. The support rods 44 may preferably be pointed, or slightly pointed, at one end thereof, to facilitate inserting the support rods 44 through the support rod apertures 46 and 48 formed in the replaceable target section 32 and central body section 16, respectively. Ease of insertion of the support rods 44 into the replaceable target section 32 is facilitated by the design of the replaceable target section 32, as described previously, which minimizes friction between the surfaces of the replaceable target section 32 and the inner surface of the target section aperture 34. This allows the replaceable target section 32 to be moved when the support rods 44 are inserted through the support rod apertures 48 in the central body section 16 and into the corresponding support rod apertures 46 formed in the replaceable target section 32, to achieve proper alignment between the support rod apertures 48 and 46.

In accordance with the present invention, the support rods 44 may serve the functions both of supporting the replaceable target section 32 in the central body section 16 and joining separate body sections of the three-dimensional archery target 10 together. For example, the support rods 44 preferably extend entirely through the support rod apertures 48 formed in the tail-end of the central body section 16, through the extending portion 26 formed thereon, into corresponding support rod apertures 50 formed in the recessed groove 24 formed in the tail body section 18. Thus, the support rods 44 reinforce the dove-tail support structure formed by the extending portion 26 and recessed groove 24.

To facilitate easy removal of the support rods 44 from the central body section 16, it is preferred that ends of the support rods 44 extend slightly from the central body section 16 when the support rods 44 are positioned therein. This allows the extending ends of the support rods 44 to be grasped more easily by hand, or with a pliers, to remove the support rods 44 from the central body section 16. In the exemplary embodiment of the archery target 10 illustrated and described herein, it is apparent that ends of the support rods 44 extending from the extending portion 22 of the central body section 16 could interfere with placement of the head body section 14 on the central body section 16. Therefore, a second recessed groove 52 is preferably formed within the recessed groove 20 formed in the head body section 14, to accommodate ends of the support rods 44 extending into the recessed groove 20 from the central body section 16 when the head body section 14 is attached thereto.

Certain portions of the replaceable target section 32 itself may be likely to receive many more arrow strikes than other portions of the replaceable target section 32. For example, a skilled archer is likely to hit near the center of the bulls' eye area of the replaceable target section 32 most of the time. Thus, certain portions of the replaceable target section 32 may be deteriorated more rapidly than other portions of the replaceable target section 32. In accordance with the present invention, the useful life of a three-dimensional archery target 10 is further enhanced by providing a replaceable target insert 60.

The replaceable target insert 60 is placed in a target insert aperture 62 formed in the replaceable target section 32. The replaceable target insert 60 preferably is made of the same foam material as the replaceable target section 32, although the replaceable insert 60 may be made of a more dense and, therefore, less rapidly deteriorated, foam material than the replaceable target section 32 and/or the target body sections 14, 16, and 18. An outside end 64 of the replaceable target insert 60 is preferably textured and/or contoured to provide a natural appearance when the replaceable target insert 60 is placed in the target insert aperture 62 such that the outside end 64 of the replaceable target insert 60 is aligned with the outside end 36 of the replaceable target section 32.

The target insert aperture 62 formed in the replaceable target section 32 preferably extends only partially through the replaceable target section 32. As illustrated in FIGS. 4 and 6, an inner end of the target insert aperture 62 is preferably smaller than an outer end of the target insert aperture 62 which is aligned with the outside end 36 of the replaceable target section 32. Similarly, the outside end 64 of the replaceable target insert 60 is preferably larger than an inside end 66 of the replaceable target insert 60. The angled inside walls of the target insert aperture 62 and the angled outside walls of the replaceable target insert 60 thus formed facilitate easy placement of the replaceable target insert 60 within the target insert aperture 62 by reducing friction between the inside walls of the target insert aperture 62 and the outside walls of the replaceable target insert 60 until the replaceable target insert 60 is placed in the desired position within the target insert aperture 62, such that the outside end 64 of the replaceable target insert 60 is aligned with the outside end 36 of the replaceable target section 32.

The shape of the replaceable target insert 60 and the corresponding shape of the target insert aperture 62 are preferably designed to facilitate placement of the replaceable target insert 60 within the target insert aperture 62 in the proper orientation. For example, an extending portion 68 may be formed on a side of the replaceable target insert 60, with a corresponding groove 70 formed in a wall of the target insert aperture 62. The replaceable target insert 60 will only fit into the target insert aperture 62 when the extending portion 68 of the replaceable target insert 60 is aligned with the corresponding groove 70 formed in the target insert aperture 62. Thus, the extending portion 68 of the replaceable target insert 60 in combination with the groove 70 formed in the target insert aperture 62 facilitate proper orientation of the replaceable target insert 60 within the target insert aperture 62.

The replaceable target insert 60 preferably is held in position in the replaceable target section 32 by one of the support rods 71 extending through the replaceable target section 32. Thus, a support rod aperture 72 is preferably formed through the replaceable target insert 60. When the replaceable target insert 60 is placed in position within the target insert aperture 62, the target insert support rod aperture 72 is aligned with a corresponding support rod aperture 74 formed in the replaceable target section 32. The target section support rod aperture 74 is, in turn, aligned with corresponding support rod apertures 76 formed in the central body section 16, and, preferably, a corresponding support rod aperture 78 formed in the tail body section 18. A support rod 71 may thus be extended through the support rod apertures 72, 74, 76, and 78, in the replaceable target insert 60, the replaceable target section 32, the central body section 16, and the tail body section 18, respectively, to hold the replaceable target insert 60, the replaceable target section 32, the central body section 16, and the tail body section 18 together.

Since the replaceable target insert 60 is likely to receive more arrow strikes than any other portion of the archery target 10, it is likely to be deteriorated rapidly. As the replaceable target insert 60 deteriorates, arrows striking the replaceable target insert 60 may penetrate deeply into the replaceable target insert 60. Therefore, it is preferred that the support rod 71 extending through the replaceable target insert 60 be made of a material which will not damage the head of an arrow, should the arrow penetrate into the replaceable target insert 60 to such a depth as to contact the support rod 71. A preferable arrow friendly material for the support rod 71 is low density polyethlylene.

The present invention provides a three-dimensional archery target, having replaceable target sections, which is easy to assemble, and which is structurally stable during use. A life-size animal-simulating archery target 10 in accordance with the present invention may be assembled as follows. The replaceable target insert 60 is placed in the target insert aperture 62 such that the support rod aperture 72 formed in the replaceable target insert 60 is aligned with the support rod aperture 74 formed in the replaceable target section 32. For proper orientation of the replaceable target insert 60 in the target insert aperture 62, the extending portion 68 of the replaceable target insert 60 is aligned with the groove 70 formed in the target insert aperture 62. The replaceable target section 32 is then placed in the replaceable target section aperture 34 formed in the central target body section 16, such that the support rod apertures 46 and 74 formed in the replaceable target section 32 are aligned with the corresponding support rod apertures 48 and 76 formed in the central target body section 16. The tail body section 18 is then attached to the central target body section 16 by inserting the extending portion 26 formed on the tail end of the central target body section 16 into the corresponding recessed groove 24 formed in the tail body section 18, such that the support rod apertures 50 and 78 formed in the tail body section 18 are aligned with the corresponding support rod apertures 48 and 76 formed in the central body section 16. The support rods 44 and 71 are then extended through the support rod apertures 48 and 76 formed in the central body section 16, through the support rod apertures 46 and 74 formed in the replaceable target section 32, through the support rod aperture 72 formed in the replaceable target insert 60, and into the support rod apertures 50 and 78 formed in the tail target body section 18. The support rods 44 and 71 thus join the pieces of the archery target 10 together to form a structurally stable archery target 10 which will not come apart during use or transportation. However, the support rods 44 and 71 may easily be removed, when necessary, e.g., to disassemble the archery target 10 to replace the replaceable target insert 60 or the replaceable target section 32 when either of these pieces becomes excessively damaged due to repeated arrow strikes. The three-dimensional life-size animal-simulating archery target 10 is completed by attaching the head body section 14 to the central body section 16 by inserting the extending portion 22 formed on the head end of the central body section 16 into the corresponding recessed groove 20 formed in the head body section 14. As discussed previously, the ends of the support rods 44 and 71 are preferably left extending from the head end of the central body section 16, to facilitate grasping the ends of the support rods 44 and 71 with the fingers or a pliers to remove the support rods 44 and 71 when it is desired to disassemble the archery target 10. The second recessed groove 52 formed in the recessed groove 20 formed in the head body section 14 is provided to prevent interference between the extending ends of the support rods 44 and 71 and the head body section 14 when the head body section 14 is positioned on the central body section 16. The archery target 10 may then be mounted for use, such as by driving stakes into the ground and attaching the mounting tubes 31 extending from the target 10 thereto.

Each section of a three-dimensional archery target 10 in accordance with the present invention, including the target body sections 14, 16, and 18, the replaceable target section 32, and the target insert 60, may be formed in a conventional manner of a polyurethane foam material. Of course, other appropriate foam or other materials may be used to form the sections of the archery target 10. Conventional molding techniques, employing molds of the desired size and shape, may be used to form the target sections 14, 16, 18, 32, and 60. The outside surfaces of the target sections 14, 16, 18, 32, and 60 may preferably be painted in a realistic manner, and covered with a UV protectant material.

The polyurethane foam material from which the target 10 is preferably formed is, in itself, not structurally strong. Thus, narrow unsupported extending portions of the target 10, such as, in this case, the target animal's ears 100 or unsupported legs 102, are likely to break off if the target 10 is dropped or otherwise mishandled, unless the foam material forming these extending portions is reinforced. This may be achieved by placing support rods, e.g., rods or tubes made of a rigid or semi-rigid material, such as plastic, within the portions of the mold used for forming these extending portions 100 and 102 of the target 10 when the target sections are formed. The support rods or tubes may be supported in the proper position in an empty mold, before the foam material of which the target 10 is formed is admitted thereto, in a variety of ways. For example, a support tube may be positioned in the portion of a mold forming the ear 100 of the target 10 by taping, e.g., using duct tape, the support rod or tube directly to the mold. The support rod or tube will then be locked in position in the ear 100 by the foam entering the mold around it. Similarly, a support rod or tube may be placed in a portion of a mold forming an extending leg 102 of the animal target using a wooden or plastic key mechanism which attaches the support rod or tube to a notch formed in the mold. When the completed archery target sections are removed from the mold, any tape or portions of a wood or plastic key mechanism extending from the finished target body section may be trimmed away with other molding residue. Support rods or tubes placed in the extending portions 100 and 102 of the target 10 allow a realistic animal target to be made, with life-like extending appendages 100 and 102 formed therein, which will not easily be broken off with mishandling of the archery target 10. It should also be noted that the portion of the central body section 16 surrounding the target section aperture 34 is relatively narrow and, therefore, relatively weak. Thus, it is also preferred that a support rod or tube be embedded in the target foam material forming the central body section 16 around the target section aperture 34. A support rod or tube may be positioned in the mold used for forming the central body section 16 in the manner described.

It should be understood that the present invention is not confined to the particular embodiments herein illustrated and described, but embraces such modified forms thereof as come within the scope of the following claims.

What is claimed is:

1. An archery target, comprising:

(a) a first target body section forming a target surface and having a target section aperture and a first body section support rod aperture extending into the target section aperture formed therein;

(b) a replaceable target section adapted to fit in the target section aperture and having a target section support rod aperture formed therein such that when the replaceable target section is positioned in the target section aperture the replaceable target section is surrounded by the first target body section and the first body section support rod aperture and the target section support rod aperture are aligned; and (c) a removable support rod extending through the first body section support rod aperture and the target section support rod aperture to support the replaceable target section in position in the target body section.

2. The archery target of claim 1 wherein the first target body section is formed in the shape of a portion of an animal.

3. The archery target of claim 1 wherein the first target body section includes additionally a portion of a support structure for attaching a second target body section thereto.

4. The archery target of claim 3 wherein the support structure for attaching the second target body section to the first target body section is a dovetail structure.

5. The archery target of claim 1 comprising additionally a second target body section having a second body section support rod aperture formed therein, and wherein the support rod extends into the second body section support rod aperture to support the second target body section in position on the first target body section.

6. The archery target of claim 1 wherein the target section aperture extends entirely through the first target body section and wherein the replaceable target section includes first and second outside ends which are aligned with an outside surface of the first target body section when the replaceable target section is positioned in the target section aperture.

7. The archery target of claim 1 wherein the first target body section includes a second body section support rod aperture extending into the target section aperture formed therein on an opposite side of the target section aperture from the first body section support rod aperture, wherein the target section support rod aperture extends entirely through the replaceable target section, and wherein the support rod extends through the first body section support rod aperture, through the target section support rod aperture, and into the second body section support rod aperture to support the replaceable target section in position in the target body section.

8. The archery target of claim 1 comprising additionally a target insert aperture formed in the replaceable target section and a replaceable target insert placed in the target insert aperture.

9. An archery target comprising:

(a) a first target body section having a target section aperture and a first body section support rod aperture extending into the target section aperture formed therein;

(b) a replaceable target section adapted to fit in the target section aperture and having a target section support rod aperture formed therein such that when the replaceable target section is positioned in the target section aperture the first body section support rod aperture and the target section support rod aperture are aligned; and (c) a support rod extending through the first body section support rod aperture and the target section support rod aperture to support the replaceable target section in position in the target body section, wherein the target section aperture extends entirely through the first target body section and is smaller at a first end thereof than at a second end thereof and wherein the replaceable target section includes first and second outside ends which are aligned with an outside surface of the first target body section when the replaceable target section is positioned in the target section aperture and the first outside end of the replaceable target section is smaller than the second outside end of the replaceable target section to facilitate insertion of the replaceable target section into the target section aperture.

10. An archery target, comprising:

(a) a first target body section having a target section aperture and a first body section support rod aperture extending into the target section aperture formed therein;

(b) a replaceable target section adapted to fit in the target section aperture and having a target section support rod aperture formed therein such that when the replaceable target section is positioned in the target section aperture the first body section support rod aperture and the target section support rod aperture are aligned; and (c) a support rod extending through the first body section support rod aperture and the target section support rod aperture to support the replaceable target section in position in the target body section, wherein the target section aperture extends entirely through the first target body section and wherein the replaceable target section includes first and second outside ends which are aligned with an outside surface of the first target body section when the replaceable target section is positioned in the target section aperture and wherein each of the first and second outside ends of the replaceable target section have a larger cross sectional area than a cross sectional area of an interior portion of the replaceable target section located between the first and second outside ends thereof such that the interior portion of the replaceable target section does not contact inside walls of the target section aperture when the replaceable target section is positioned in the target section aperture to facilitate insertion of the replaceable target section into the target section aperture.

11. An archery target, comprising:

(a) a first target body section having a target section aperture and a first body section support rod aperture extending into the target section aperture formed therein;

(b) a replaceable target section adapted to fit in the target section aperture and having a target section support rod aperture formed therein such that when the replaceable target section is positioned in the target section aperture the first body section support rod aperture and the target section support rod aperture are aligned;

(c) a support rod extending through the first body section support rod aperture and the target section support rod aperture to support the replaceable target section in position in the target body section; and (d) a target insert aperture formed in the replaceable target section and a replaceable target insert placed in the target insert aperture, wherein the target insert aperture and the replaceable target insert are shaped such that the replaceable target insert is placeable in the target insert aperture in only one correct orientation.

12. An archery target, comprising:

(a) a first target body section having a target section aperture and a first body section support rod aperture extending into the target section aperture formed therein;

(b) a replaceable target section adapted to fit in the target section aperture and having a target section support rod aperture formed therein such that when the replaceable target section is positioned in the target section aperture the first body section support rod aperture and the target section support rod aperture are aligned;

(c) a support rod extending through the first body section support rod aperture and the target section support rod aperture to support the replaceable target section in position in the target body section; and (d) a target insert aperture formed in the replaceable target section and a replaceable target insert placed in the target insert aperture, wherein the target section support rod aperture extends into the target insert aperture, wherein the replaceable target insert includes a target insert support rod aperture formed therein such that when the replaceable target insert is placed in the target insert aperture the target section support rod aperture and the target insert support rod aperture are aligned, and wherein the support rod extends through the target section support rod aperture into the target insert support rod aperture to support the replaceable target insert in position in the replaceable target section.

13. A replaceable archery target section adapted to fit in a target section aperture formed in a body section of an archery target, comprising:

(a) a first outside end portion adapted to be aligned with an outside target surface of the body section of the archery target when the replaceable archery target section is placed in the target section aperture;

(b) an interior portion adapted to be located within the target section aperture of and surrounded by the body section of the archery target; and (c) a target section support rod aperture formed through the interior portion.

14. The replaceable archery target section of claim 13 including additionally a second outside end portion adapted to be aligned with the outside surface of the body section of the of the archery target when the replaceable archery target section is placed in the target section aperture.

15. The replaceable archery target section of claim 13 wherein the target section support rod aperture extends entirely through the interior portion of the replaceable archery target section.

16. The replaceable archery target section of claim 13 comprising additionally a target insert aperture formed in the replaceable archery target section and a replaceable target insert placed in the target insert aperture.

17. The replaceable archery target section of claim 16 wherein the target section support rod aperture extends into the target insert aperture, and wherein the replaceable target insert includes a target insert support rod aperture formed therein such that when the replaceable target insert is placed in the target insert aperture the target section support rod aperture and the target insert support rod aperture are aligned.

18. A replaceable archery target section adapted to fit in a target section aperture formed in a body section of an archery target, comprising:

(a) a first outside end portion adapted to be aligned with an outside surface of the body section of the archery target when the replaceable archery target section is placed in the target section aperture;

(b) an interior portion adapted to be located within the target section aperture of the body section of the archery target;

(c) a target section support rod aperture formed through the interior portion; and (d) a second outside end portion adapted to be aligned with the outside surface of the body section of the of the archery target when the replaceable archery target section is placed in the target section aperture, and wherein the first outside end portion of the replaceable archery target section is smaller than the second outside end portion of the replaceable archery target section to facilitate insertion of the replaceable archery target section into the target section aperture.

19. A replaceable archery target section adapted to fit in a target section aperture formed in a body section of an archery target, comprising:

(a) a first outside end portion adapted to be aligned with an outside surface of the body section of the archery target when the replaceable archery target section is placed in the target section aperture;

(b) an interior portion adapted to be located within the target section aperture of the body section of the archery target;

(c) a target section support rod aperture formed through the interior portion; and (d) a second outside end portion adapted to be aligned with the outside surface of the body section of the of the archery target when the replaceable archery target section is placed in the target section aperture, and wherein each of the first and second outside end portions of the replaceable archery target section have a greater cross sectional area than a cross sectional area of the interior portion of the replaceable archery target section located between the first and second outside end portions thereof such that the interior portion of the replaceable archery target section does not contact inside walls of the target section aperture when the replaceable archery target section is positioned in the target section aperture to facilitate insertion of the replaceable archery target section into the target section aperture.

20. A replaceable archery target section adapted to fit in a target section aperture formed in a body section of an archery target, comprising:

(a) a first outside end portion adapted to be aligned with an outside surface of the body section of the archery target when the replaceable archery target section is placed in the target section aperture;

(b) an interior portion adapted to be located within the target section aperture of the body section of the archery target;

(c) a target section support rod aperture formed through the interior portion; and (d) a target insert aperture formed in the replaceable archery target section and a replaceable target insert placed in the target insert aperture, wherein the target insert aperture and the replaceable target insert are shaped such that the replaceable target insert is placeable in the target insert aperture in only one correct orientation.

21. An archery target, comprising:

(a) a first target body section having a first body section support rod aperture formed therein;

(b) a second target body section having a second body section support rod aperture formed therein;

(c) a target section aperture formed in the first target body section;

(d) a replaceable target section adapted to fit in the target section aperture and having a target section support rod aperture formed therein such that when the replaceable target section is positioned in the target section aperture the first body section support rod aperture and the target section support rod aperture are aligned; and (e) a removable support rod extending through the first body section support rod aperture and the second body section support rod aperture to connect the first target body section to the second target body section and extending through the target section support rod aperture to support the replaceable target section in position in the first target body section.

22. The archery target of claim 21 comprising additionally a target insert aperture formed in the replaceable target section and a replaceable target insert placed in the target insert aperture.

23. The archery target of claim 22 wherein the target section support rod aperture extends into the target insert aperture, wherein the replaceable target insert includes a target insert support rod aperture formed therein such that when the replaceable target insert is placed in the target insert aperture the target section support rod aperture and the target insert support rod aperture are aligned, and wherein the support rod extends through the target section support rod aperture into the target insert support rod aperture to support the replaceable target insert in position in the replaceable target section.

24. A method for assembling an archery target, comprising the steps of:

(a) providing a first target body section forming a target surface and having a target section aperture and a first body section support rod aperture extending into the target section aperture formed therein;

(b) placing a replaceable target section having a target section support rod aperture formed therein into the target section aperture such that the replaceable target section is surrounded by the first target body section and the first body section support rod aperture and the target section support rod aperture are aligned; and (c) extending a removable support rod through the first body section support rod aperture and the target section support rod aperture to support the replaceable target section in position in the target body section.

25. The method of claim 24 comprising additionally the step of inserting a replaceable target insert into a target insert aperture formed in the replaceable target section.

26. The method of claim 25 wherein the replaceable target insert includes a target insert support rod aperture formed therein, wherein the step of inserting the replaceable target insert into the target insert aperture includes the step of placing the replaceable target insert into the target insert aperture such that the target section support rod aperture and the target insert support rod aperture are aligned, and wherein the step of extending the support rod through the first body section support rod aperture and the target section support rod aperture includes the step of extending the support rod through the target section support rod aperture into the target insert support rod aperture to support the replaceable target insert in position in the replaceable target section.

27. An archery target, comprising:

(a) a first target body section having a first body section support rod aperture formed therein;

(b) a second target body section having a second body section support rod aperture formed therein; and (c) a removable support rod extending through the first body section support rod aperture and the second body section support rod aperture to connect the first target body section to the second target body section;

wherein the first and second target body sections include additionally corresponding portions of a dovetail support structure for attaching the first and second target body sections together.

* * * * *